US006922878B1

(12) United States Patent
Lettau et al.

(10) Patent No.: US 6,922,878 B1
(45) Date of Patent: Aug. 2, 2005

(54) METHOD AND DEVICE FOR ROLLING A FOIL OF VARYING THICKNESSES

(75) Inventors: Ulrich Lettau, Erlangen (DE); Siegbert Steidl, Herzogenaurach (DE); Wilfried Tautz, Forchheim (DE); Dietrich Wohld, Rauschenberg (DE)

(73) Assignee: Siemens Aktiengesselschaft, Munich (DE)

( * ) Notice: Subject to any disclaimer, the term of this patent is extended or adjusted under 35 U.S.C. 154(b) by 0 days.

(21) Appl. No.: 10/030,333

(22) PCT Filed: Jun. 26, 2000

(86) PCT No.: PCT/DE00/02073

§ 371 (c)(1),
(2), (4) Date: Oct. 1, 2002

(87) PCT Pub. No.: WO01/02109

PCT Pub. Date: Jan. 11, 2001

(30) Foreign Application Priority Data

Jul. 1, 1999 (DE) ..... 199 30 472

(51) Int. Cl.[7] ..... B21D 33/00
(52) U.S. Cl. ..... 29/17.3; 29/17.1; 29/17.2
(58) Field of Search ..... 29/17.2, 17.3, 29/17.1; 72/10.7, 234, 240

(56) References Cited

U.S. PATENT DOCUMENTS 4,506,532 A * 3/1985 Anbe ..... 72/10.7
5,740,686 A * 4/1998 Martinetz et al. ..... 72/8.4

* cited by examiner

*Primary Examiner*—John C. Hong
(74) *Attorney, Agent, or Firm*—Baker Botts LLP

(57) ABSTRACT

A method and a device for rolling a metal strip (1) in a rolling train, the rolling train having at least two rolling stands, the metal strip (1) having at least two partial areas (3, 4) of different thicknesses, which are connected to one another via a wedge-shaped or approximately wedge-shaped transition piece (2), and the rolling velocity of a rolling stand, during the rolling of the wedge-shaped or approximately wedge-shaped transition piece (2), being set as a function of the forward slip of the rolling stand and of the temperature of the metal strip.

2 Claims, 3 Drawing Sheets

METHOD AND DEVICE FOR ROLLING A FOIL OF VARYING THICKNESSES

DESCRIPTION

The invention relates to a method and a device for rolling a metal strip in a rolling train, the rolling train having at least two rolling stands, the metal strip having at least two partial areas of different thicknesses, which are connected to one another via a wedge-shaped or approximately wedge-shaped transition piece, and the rolling velocity of a rolling stand, during the rolling of the wedge-shaped or approximately wedge-shaped transition piece, being set as a function of the forward slip of the rolling stand, in particular in accordance with DE-A 197 49 424.

Continuous rolling leads to changes in thickness of more than 20%, which impose high demands on the setting of the rolling train. On account of the temperature of the strip during hot-rolling, there is only little room for maneuver between looping and necking. This applies all the more if there are changes in thickness of 50% and more. DE-A 197 49 424 teaches a method for reducing scrap during the hot-rolling of corresponding strips. It is an object of the invention to further improve the quality of the rolled product in a procedure of this type.

According to the invention, the object is achieved by a method in accordance with claim 1 and a device for rolling a metal strip in a rolling train in accordance with claim 2, in which, to roll a metal strip in a rolling train, the rolling train has at least two rolling stands, the metal strip having at least two partial areas of different thicknesses, which are connected to one another via a wedge-shaped or approximately wedge-shaped transition piece, and the rolling velocity of a rolling stand, during the rolling of the wedge-shaped or approximately wedge-shaped transition piece, procedure in accordance with DE-A 197 49 424 for a three-stand rolling train. This figure illustrates the set values for the rolling velocities being set as a function of the forward slip of the rolling stand and the temperature of the metal strip.

Further advantages and details will emerge from the following description of exemplary embodiments. In the drawing.

Figure 1:
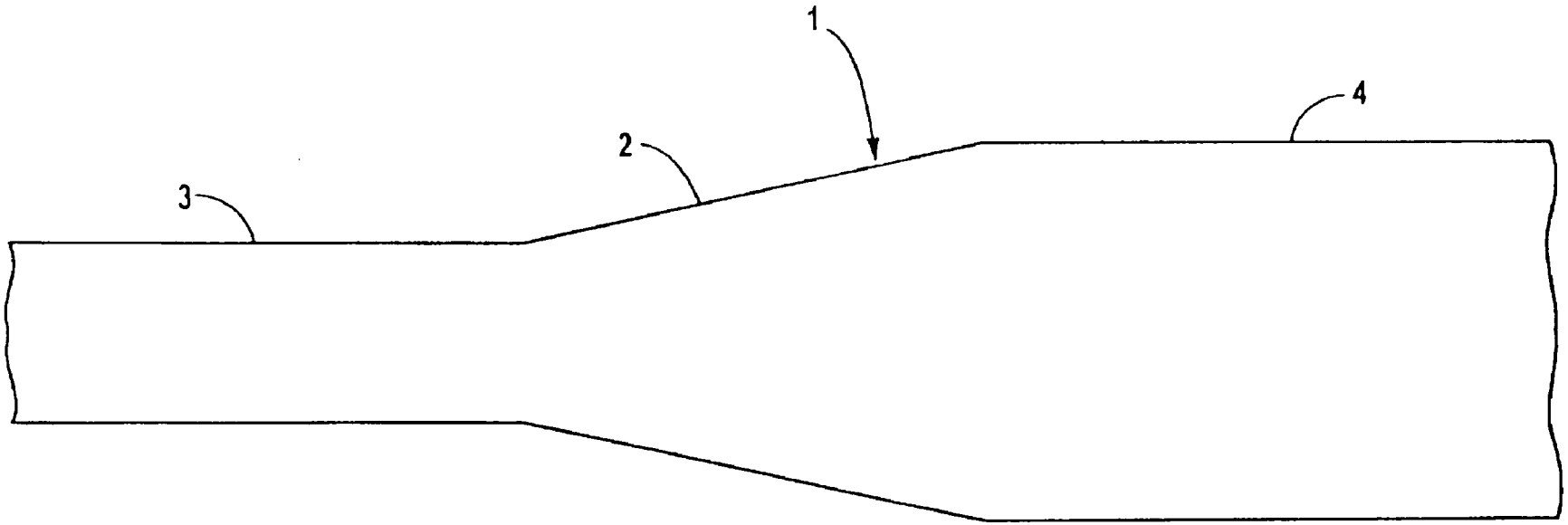
FIG. 1 shows a metal strip of variable thickness.
Figure 2:
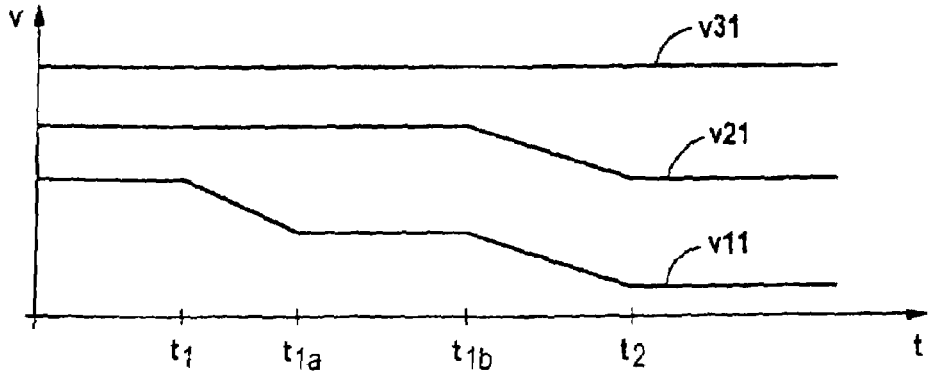
FIG. 2 shows the curve of set rolling velocities in analogy to the method described in DE-A 197 49 424.

FIG. 1 shows a metal strip 1 of variable thickness resulting from a changeover of the pass sequence during rolling. When it exits the final stand of the rolling train, the metal strip 1 has an area 4 having the greater thickness, which corresponds to the thickness in accordance with the old pass sequence, and an area 3 of lesser thickness, which corresponds to the thickness in accordance with the new pass sequence. Between the two areas 3 and 4, the metal strip 1 has a wedge-shaped intermediate piece 2. During the changeover of the pass sequence, the reductions and exit thicknesses of all the rolling stands generally change. Therefore, for example according to DE-A 197 49 424, the rolling stands are changed over from the old pass sequence to the new pass sequence at the appropriate time. FIG. 2 shows how the set rolling velocity is adapted in analogy to the v plotted against the time t. V11 denotes the rolling velocity of the first stand, v21 denotes the rolling velocity of the second rolling stand and v31 denotes the rolling velocity of the third rolling stand.

Figure 3:
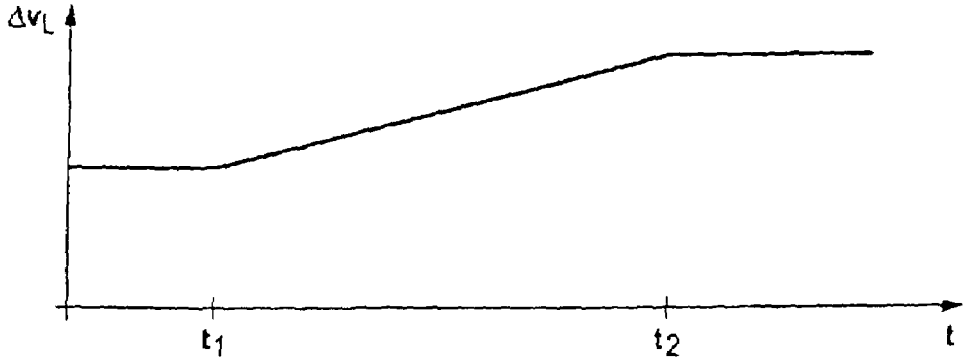
FIG. 3 shows addition values for the set rolling velocity.
Figure 4:
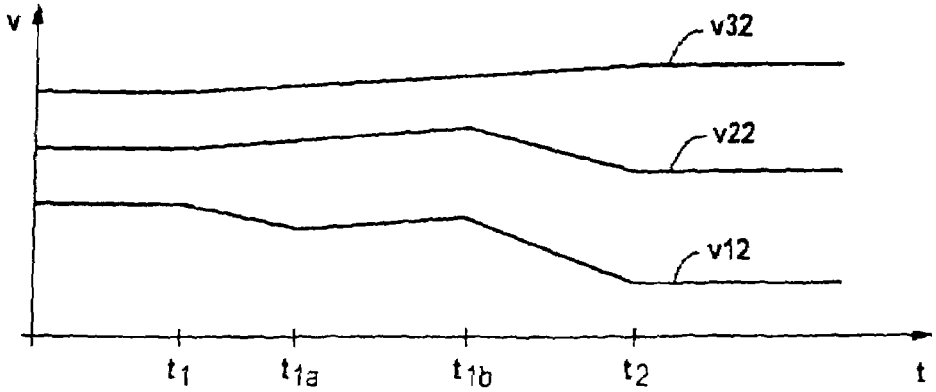
FIG. 4 shows set rolling velocity curves taking account of the forward slip of the rolling stand and the temperature of the metal strip.

FIG. 3 shows an addition value $\Delta v_L$ for the set rolling velocity as a function of time t. For the sake of clarity, the scale of the velocity is increased compared to FIG. 2 and FIG. 4. The addition value $\Delta v_L$ for the set rolling velocity is set in such a manner that the temperature of the strip corresponds as accurately as possible to a desired set temperature. The set velocities are changed by the addition value $\Delta v_L$ compared to FIG. 2. FIG. 4 shows the result. In this figure, v12 denotes the set rolling velocity of the first stand, v22 denotes the set rolling velocity of the second stand and v32 denotes the set rolling velocity of the third stand.

Figure 5:
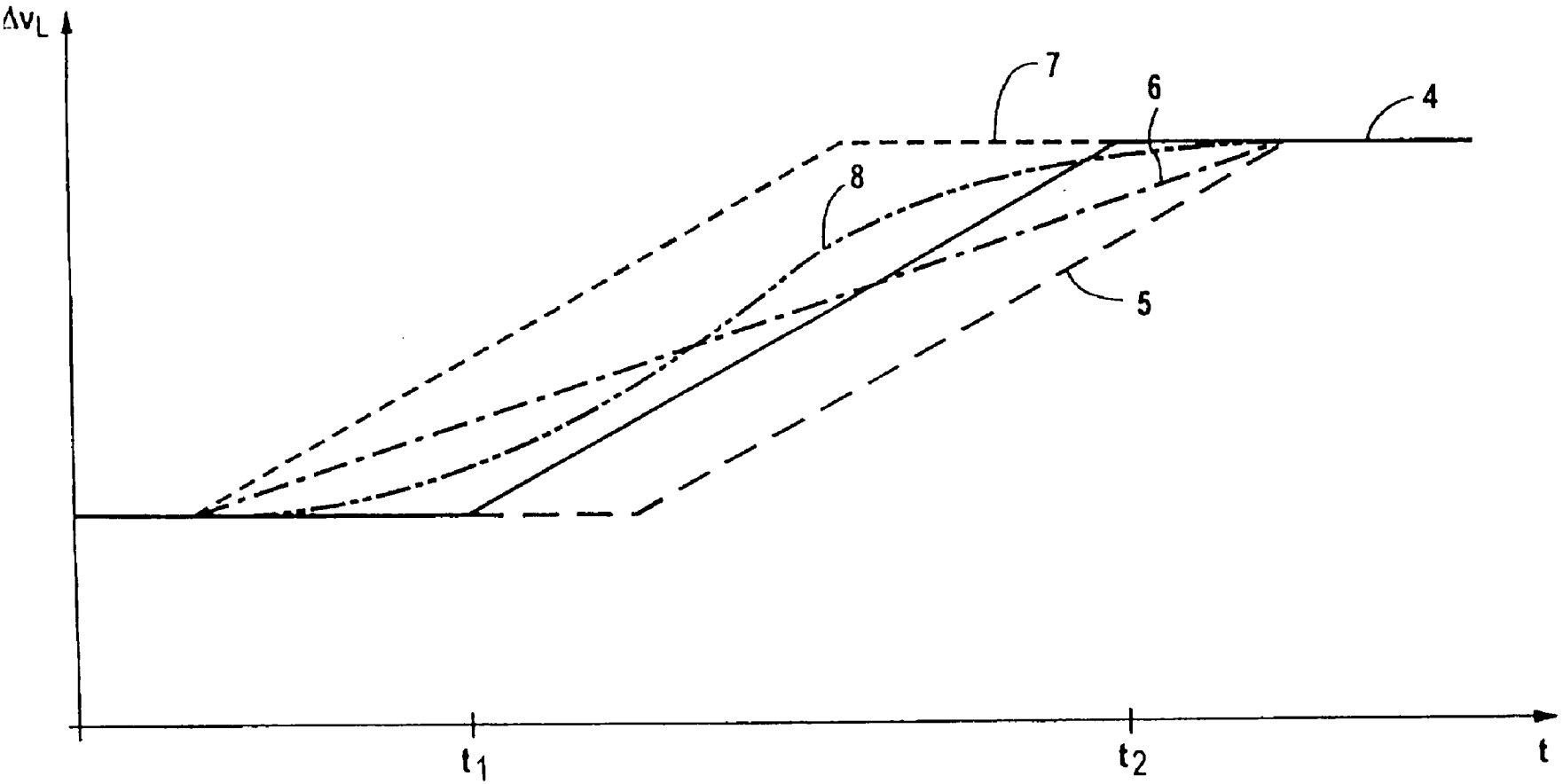
FIG. 5 shows alternative curves for addition values of the set velocity.

In addition to the curve 4 of the addition value $\Delta v_L$ shown in FIG. 3, FIG. 5 shows further possible curves 5, 6, 7, 8 for the addition value $\Delta v_L$. The choice of a suitable curve 4, 5, 6, 7, 8 for the value $\Delta v_L$ depends on how the desired temperature of the metal strip is to be set in a suitable way. Moreover, it is possible to take account of boundary or auxiliary conditions, for example load limits of the roll drives.

It is particularly advantageous to calculate a suitable curve 4, 5, 6, 7, 8 for the addition value $\Delta v_L$ by adaptation, for example by means of a neural network.

What is claimed is:

1. A method for rolling a metal strip in a rolling train having at least two rolling stands and wherein the metal strip has at least two areas of different thickness which are connected to one another via a generally wedge-shaped transition section, comprising setting a rolling velocity of a rolling stand, during the rolling of the transition section as a function of the rolling stand's forward slip; setting the rolling velocity of a rolling stand, during rolling of the transition section, as a function of a temperature of the metal strip; setting the rolling velocity of a rolling stand using an additional value ($\Delta v_L$) for controlling the temperature of the metal strip; and setting the temperature of the metal strip to a desired temperature using the $\Delta v_L$.

2. Apparatus for rolling a metal strip having at least two areas of different thickness connected to one another by a generally wedge-shaped transition section comprising a rolling train having at least two rolling stands; means for setting a rolling velocity of a rolling stand during the rolling of a transition section as a function of the rolling stand's forward slip; means for setting the rolling velocity of a rolling stand, during rolling of the transition section, as a function of a temperature of the metal strip; means for controlling the temperature of the metal strip which utilizes an additional value, which additional value is used to set the temperature of the metal strip to a desired temperature.

* * * * *